US011184720B2

(12) United States Patent
Yoshikawa et al.

(10) Patent No.: US 11,184,720 B2
(45) Date of Patent: Nov. 23, 2021

(54) ELECTROACOUSTIC TRANSDUCER AND ACOUSTIC DEVICE

(71) Applicant: RION CO., LTD., Kokubunji (JP)

(72) Inventors: Kyoji Yoshikawa, Kokubunji (JP); Takashi Iwakura, Kokubunji (JP)

(73) Assignee: RION CO., LTD., Tokyo (JP)

( * ) Notice: Subject to any disclaimer, the term of this patent is extended or adjusted under 35 U.S.C. 154(b) by 0 days.

(21) Appl. No.: 17/044,581

(22) PCT Filed: Apr. 5, 2019

(86) PCT No.: PCT/JP2019/015196
§ 371 (c)(1),
(2) Date: Oct. 1, 2020

(87) PCT Pub. No.: WO2019/198647
PCT Pub. Date: Oct. 17, 2019

(65) Prior Publication Data

US 2021/0029477 A1 Jan. 28, 2021

(30) Foreign Application Priority Data

Apr. 12, 2018 (JP) ..... JP2018-077190

(51) Int. Cl.
*H04R 25/00* (2006.01)
*H04R 1/10* (2006.01)
*H04R 7/02* (2006.01)

(52) U.S. Cl.
CPC ..... *H04R 25/606* (2013.01); *H04R 1/1016* (2013.01); *H04R 7/02* (2013.01)

(58) Field of Classification Search
CPC ..... H04R 25/606; H04R 1/1016; H04R 7/02
(Continued)

(56) References Cited

U.S. PATENT DOCUMENTS 7,841,446 B2 * 11/2010 Leong ..... A61F 11/08 181/135
2009/0226024 A1 * 9/2009 Dean ..... H04R 1/1016 381/379
(Continued)

FOREIGN PATENT DOCUMENTS

JP 2007103989 A 4/2007
JP 2011160175 A 8/2011
(Continued)

OTHER PUBLICATIONS

International Search Report and Written Opinion for related PCT App No. PCT/JP2019/015196 dated May 28, 2019, 9 pgs.

*Primary Examiner* — Sean H Nguyen
(74) *Attorney, Agent, or Firm* — Procopio, Cory, Hargreaves & Savitch LLP

(57) ABSTRACT

An electroacoustic transducer includes an electromechanical transducer and a casing. The electromechanical transducer transduces an electric signal into mechanical vibration. The housing can be attached to a cavum conchae without blocking an external auditory canal, in which the electromechanical transducer is housed, and vibrates due to the mechanical vibration caused by the electromechanical transducer to generate sound. The housing includes an inner housing portion located on the external auditory canal side and an outer housing portion located on an external environment side when the housing is attached to the cavum conchae. The housing has an ellipsoidal shape or an oval shape.

7 Claims, 7 Drawing Sheets

(58) Field of Classification Search
USPC ..... 381/328
See application file for complete search history.

(56) References Cited

U.S. PATENT DOCUMENTS

| | | | | |
|---|---|---|---|---|
| 2012/0244917 | A1 | 9/2012 | Hosoi et al. | |
| 2012/0289162 | A1 | 11/2012 | Hosoi et al. | |
| 2013/0242809 | A1 | 9/2013 | Tone et al. | |
| 2013/0324193 | A1 | 12/2013 | Hosoi et al. | |
| 2014/0378191 | A1 | 12/2014 | Hosoi et al. | |
| 2015/0065057 | A1 | 3/2015 | Hosoi et al. | |
| 2015/0141088 | A1 | 5/2015 | Hosoi et al. | |
| 2015/0181338 | A1 | 6/2015 | Hosoi et al. | |
| 2015/0207392 | A1 | 7/2015 | Iwakura et al. | |
| 2016/0205233 | A1 | 7/2016 | Hosoi et al. | |
| 2016/0286296 | A1 | 9/2016 | Hosoi et al. | |
| 2016/0373851 | A1* | 12/2016 | Prelogar | A44C 7/00 |
| 2017/0006144 | A1 | 1/2017 | Hosoi et al. | |
| 2017/0353797 | A1 | 12/2017 | Hosoi et al. | |
| 2018/0199127 | A1 | 7/2018 | Hosoi et al. | |
| 2018/0262839 | A1 | 9/2018 | Hosoi et al. | |
| 2018/0352061 | A1 | 12/2018 | Hosoi et al. | |
| 2020/0068308 | A1 | 2/2020 | Hosoi et al. | |

FOREIGN PATENT DOCUMENTS

| | | | |
|---|---|---|---|
| JP | 2012222682 | A | 11/2012 |
| JP | 2014116755 | A | 6/2014 |
| JP | 2015139041 | A | 7/2015 |
| JP | 2016063276 | A | 4/2016 |

* cited by examiner

ELECTROACOUSTIC TRANSDUCER AND ACOUSTIC DEVICE

CROSS-REFERENCE TO RELATED APPLICATIONS

This application is a U.S. National Stage entry of PCT Application No: PCT/JP2019/015196 filed Apr. 5, 2019, which claims priority to Japanese Patent Application No. 2018-077190 filed Apr. 12, 2018, the contents of which are incorporated herein by reference.

TECHNICAL FIELD

The present invention relates to an electroacoustic transducer and an acoustic device for transmitting sound to a wearer. In particular, it relates to an electroacoustic transducer that vibrates a housing by mechanical vibration caused by an electromechanical transducer to transmit sound, and an audio device that is configured to include the electroacoustic transducer and a sound source.

BACKGROUND ART

In electroacoustic transducers and acoustic devices for transmitting sounds to wearers such as hearing aids and earphones, there has been heretofore proposed an electroacoustic transducer or an acoustic device that has no sound outlet but can transduce an electrical signal into mechanical vibration by an electromechanical transducer, and vibrate a housing by the mechanical vibration so as to generate air conduction sound (sound that is transmitted by vibrating air in an external auditory canal) or bone conduction sound (sound that is transmitted by vibrating the skull) and transmit the sound to an inner ear.

For example, PTL 1 discloses a bone conduction earphone that generates bone conduction sound. The bone conduction earphone has a bone conduction vibration portion which is formed into an ellipsoidal shape and which has a form provided with protrusions on an inner side (referred to as front side in PTL 1) and an outer side (referred to as back side in PTL 1). The bone conduction earphone has a configuration in which when the bone conduction earphone is worn in a cavum conchae, one longitudinal end portion of the bone conduction vibration portion is pressed against a tragus and a wall portion of the cavum conchae, the other longitudinal end of the bone conduction vibration portion is pressed against an antitragus and the wall portion of the cavum conchae, the outer side protrusion is pressed against the tragus, and further, the inner side protrusion is pressed against the circumference of an inlet of an external auditory canal in the wall portion of the cavum conchae.

PTL 2 discloses a receiver provided with a rod-like bone conduction speaker portion and a ring-like vibration transmitting portion. Here, the bone conduction speaker portion is configured to be coupled to the vibration transmitting portion at its one longitudinal end through a support portion and to protrude outside an auricle from the vicinity of an intertragic notch. The vibration transmitting portion is formed to have a size that is pressed against a tragus and an antitragus.

CITATION LIST

Patent Literature

PTL 1: JP2012-222682A
PTL 2: JP2007-103989A

SUMMARY OF INVENTION

Technical Problem

Recently, there is a demand to also hear ambient sound while listening to sound (for example, music etc.) based on vibration emitted from an electroacoustic transducer. However, when the bone conduction earphone according to PTL 1 is worn in the cavum conchae, the external auditory canal is blocked. For this reason, it is difficult to directly hear the ambient sound while using the electroacoustic transducer. On the other hand, the receiver according to PTL 2 has the vibration transmitting portion formed into the ring shape or the like. Thus, the external auditory canal is open even in a state in which the reception device is worn in the cavum conchae. Consequently, it is possible to hear the ambient sound while listening to the sound generated by the electroacoustic transducer. However, the bone conduction speaker portion is arranged on an outer side of the intertragic notch. According to this structure, the sound is easily emitted to the outside.

To solve such a problem, an object of the present invention is to provide an electroacoustic transducer and an acoustic device, by which it is possible to also hear ambient sound while listening to sound obtained by vibration based on an electric signal, that can suppress radiated sound (sound leakage) to an external environment due to vibration of a housing, and that is also easily worn in a cavum conchae.

Solution to Problem

The electroacoustic transducer in the present invention includes: an electromechanical transducer that transduces an electric signal into mechanical vibration; and a housing that can be attached to a cavum conchae without blocking an external auditory canal, in which the electromechanical transducer is housed, and that vibrates due to the mechanical vibration caused by the electromechanical transducer to generate sound, wherein: the housing includes an inner housing portion and an outer housing portion so that when the housing is attached to the cavum conchae, the inner housing portion is located on the external auditory canal side and the outer housing portion is located on an external environment side; and the housing has an ellipsoidal shape or an oval shape.

In such an electroacoustic transducer, the housing has the ellipsoidal shape or the oval shape whose width is preferably not smaller than 10 mm and not larger than 14 mm.

The electromechanical transducer preferably vibrates the housing in a direction toward the external auditory canal.

In addition, the electromechanical transducer is preferably disposed in the housing at such a position that the center of the electromechanical transducer coincides with the center of the housing.

Further, the outer housing portion preferably includes a cord leading-out portion through which a cord connected to the electromechanical transducer is inserted.

Advantageous Effects of Invention

In the present invention, the housing vibrated by the electromechanical transducer is attached to the cavum conchae without blocking the external auditory canal. Accordingly, it is possible to hear ambient sound as air conduction sound while using, as an acoustic device. In addition, in the case where the cord leading-out portion is provided on the outer housing portion, the cord leading-out portion is positioned to be received in an intertragic notch when the housing is attached to the cavum conchae. Accordingly, the housing can be attached to the cavum conchae easily and stably.

Further, in the electroacoustic transducer in which the housing is vibrated by the electromechanical transducer, not only the inner housing portion that abuts against a wall portion of the cavum conchae but also the outer housing portion that is opposed to the inner housing portion vibrate when the electromechanical transducer is driven. Therefore, the vibration of the outer housing portion may be transmitted to air, thereby resulting in sound leakage to the surroundings. On the other hand, the outer shape of the housing according to the present invention is entirely formed as an approximately curved shape like an ellipsoidal shape or an oval shape, and the housing is small-sized. Therefore, when the housing vibrates at a position where its distance to a person in the surroundings is sufficiently far in comparison with the size of the housing, sound generated by vibration of the inner housing portion and sound generated by vibration of the outer housing portion are cancelled with each other. As a result, an effect of suppressing the sound leakage to the surroundings can be also obtained.

BRIEF DESCRIPTION OF DRAWINGS

FIGS. 1A to 1D illustrate an embodiment of an electroacoustic transducer (earphone) according to the present invention, and in which FIG. 1A is a perspective view, and FIG. 1B is an explanatory view about three semiaxes orthogonal to one another in an ellipsoidal shape, FIG. 1C is a front view, and FIG. 1D is a side view.

FIGS. 2A and 2B illustrate a structure of an electromechanical transducer included in the earphone shown in FIG. 1A, and in which FIG. 2A is an exploded perspective view, and FIG. 2B is a perspective view after assembling.

FIGS. 5A and 5B illustrate an adapter attached to the earphone shown in FIG. 1A, and in which FIG. 5A is a perspective view of the adapter, and FIG. 5B is a perspective view showing a state where the adapter has been attached to the earphone.

DESCRIPTION OF EMBODIMENT

Figure 1A:
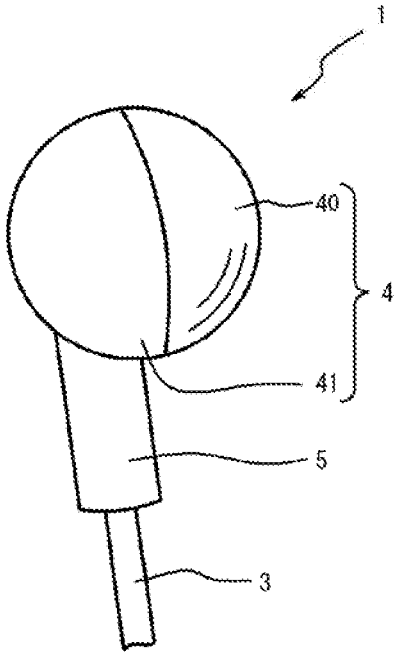
Figure 1B:
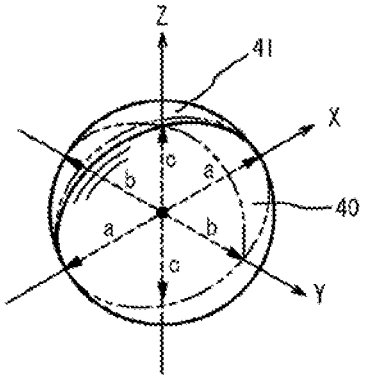
Figure 1C:
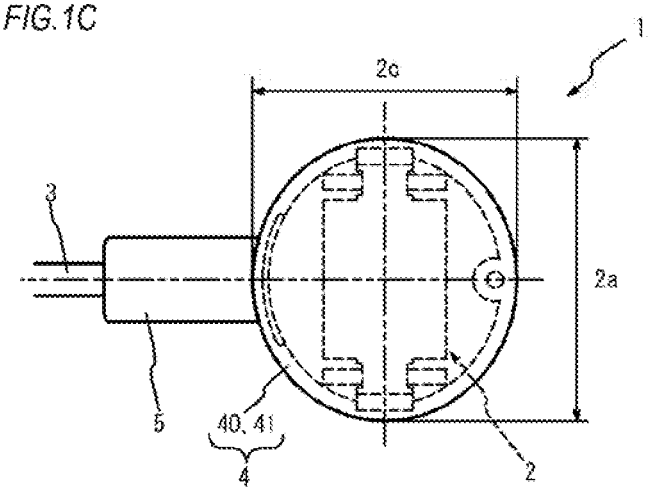

An embodiment of an earphone, which is an electroacoustic transducer in accordance with the present invention, will be described below with reference to the drawings. As shown in FIG. 1A and FIG. 1C, the earphone 1 according to the present embodiment is provided with an electromechanical transducer 2, a cord 3, a housing 4, and a cord leading-out portion 5. The cord 3 is connected to the electromechanical transducer 2. The electromechanical transducer 2 is housed in the housing 4. The cord leading-out portion 5 is coupled to the housing 4 to serve as an outlet of the cord 3.

The electromechanical transducer 2 transduces an electric signal transmitted through the cord 3 into mechanical vibration. The electromechanical transducer 2 according to the present embodiment is a balanced armature type electromechanical transducer that uses restoring forces of springs and that has a configuration the same as the electromechanical transducer described in Japanese Patent No. 5653543.

Figure 2A:
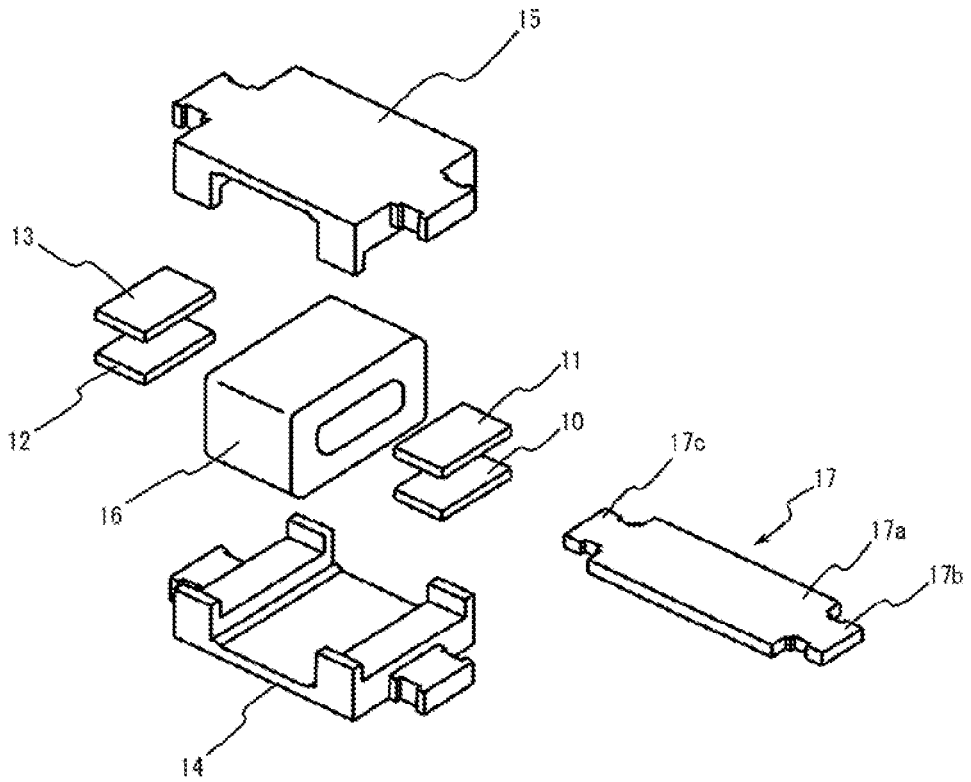
Figure 2B:
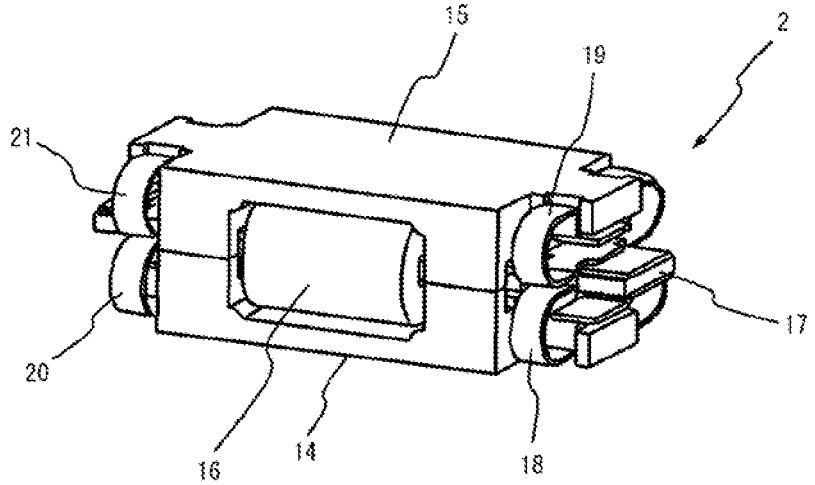

Here, a specific configuration of the electromechanical transducer 2 will be described with reference to FIG. 2A and FIG. 2B. The electromechanical transducer 2 is provided with a structure portion in which paired magnets 10 to 13, yokes 14 and 15 and a coil 16 are integrally arranged. The yokes 14 and 15 guide magnetic fluxes generated by the magnets 10 to 13. An electric signal from the cord 3 is supplied to the coil 16. Further, an armature 17 is provided in a center in the thickness direction of the structure portion. The armature 17 has an inner portion 17*a* penetrating an internal space of the structure portion, and a first outer portion 17*b* and a second outer portion 17*c* protruding from opposite sides of the inner portion. The armature 17 configures a magnetic circuit together with the structure portion through two regions of the inner portion to which the magnetic fluxes reverse to each other are guided. Further, first elastic mechanisms 18 and 19 and second elastic mechanisms 20 and 21 are provided on opposite end portions of the armature 17. The first elastic mechanisms 18 and 19 are held between the first outer portion 17*b* and the structure portion to give, to the first outer portion 17*b*, restoring forces corresponding to a displacement of the armature 17 caused by magnetic force of the magnetic circuit. The second elastic mechanisms 20 and 21 are held between the second outer portion 17*c* and the structure portion to give, to the second outer portion 17*c*, restoring forces corresponding to the displacement of the armature 17. Moreover, each of the first and second elastic mechanisms 18 to 21 includes a pair of elastic members which are arranged symmetrically with respect to a displacement direction of the armature 17 while interposing the armature 17 therebetween, and the structure portion has elastic member attachment portions to which the elastic members are attached respectively. Each of the paired elastic members is arranged in a state in which one end is engaged with the first or second outer portion 17*b* or 17*c*, and the other end is engaged with one of the elastic member attachment portions. The remaining configuration of the electromechanical transducer 2 is the same as that according to Japanese Patent No. 5653543 and will be therefore omitted here.

The first and second outer portions 17*b* and 17*c* of the armature 17 in such an electromechanical transducer 2 are fixedly supported by the housing 4. When an electric signal is applied through the cord 3, driving force is generated between the aforementioned structure portion and the armature 17 so that the armature 17 is displaced relatively. On the other hand, the armature unit 17 is returned to its original position by the restoring forces from the first and second elastic mechanisms 18 to 21 supporting the armature 17. For this reason, mechanical vibration corresponding to the electric signal is generated in the armature 17, and the mechanical vibration is transmitted from the armature 17 to the housing 4. Accordingly, the housing 4 can be vibrated.

Figure 3:
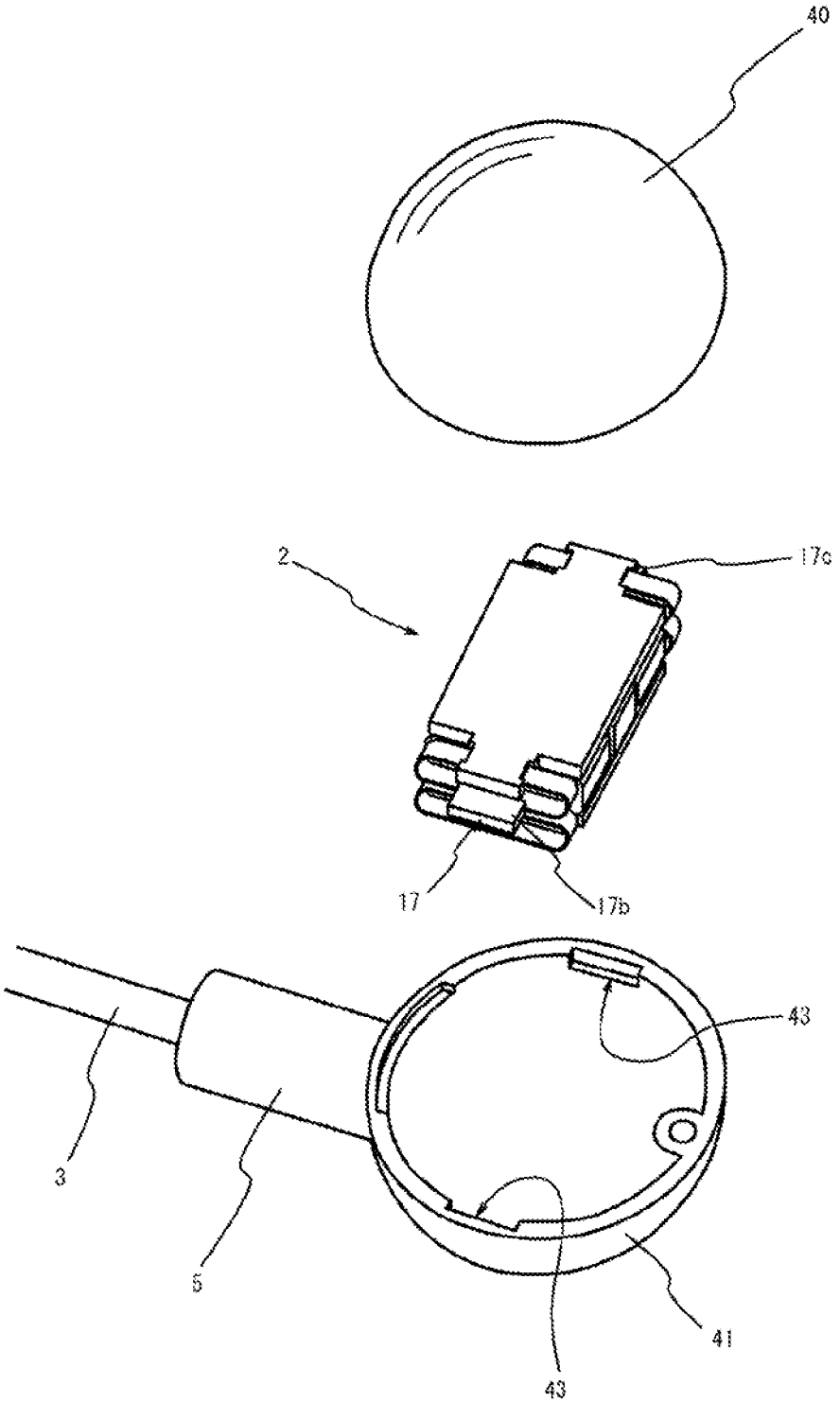
FIG. 3 is an exploded perspective view of the earphone shown in FIG. 1A.

As shown in FIG. 1A, the housing 4 is provided with an inner housing portion 40, an outer housing portion 41, and the cord leading-out portion 5. When the earphone 1 is worn in a cavum conchae of a wearer's ear, the inner housing portion 40 is located on an inner side (an external auditory canal side of the wearer's ear) to abut against a wall portion of the cavum conchae. The outer housing portion 41 which is opposed to the inner housing portion 40 is located on an external environment side when the earphone 1 is worn in the cavum conchae. The cord leading-out portion 5 is coupled to the outer housing portion 41, and the cord 3 is inserted through the cord leading-out portion 5. The inner housing portion 40 and the outer housing portion 41 in the present embodiment are provided with recessed portions 43 into which the first and second outer portions 17*b* and 17*c* of the armature 17 are fitted, as shown in FIG. 3. For example, by use of an adhesive agent or the like, the inner housing part 40 and the outer housing part 41 are bonded to each other in a state in which the first and second outer portions 17*b* and 17*c* of the armature 17 are fixedly supported. The housing 4 does not have any sound outlet, and no opening is provided in the inner housing portion 40 and the outer housing portion 41 except for a hole for inserting the cord 3 in the cord leading-out portion 5. By sealing the opening of the cord leading-out portion 5, the inside of the housing 4 can be also hermitically sealed. In addition, the cord leading-out portion 5 may be formed into such a structure that the cord leading-out portion 5 serving as a separate member is integrally molded with the cord 3 and provided in the outer housing portion 41.

Figure 1D:
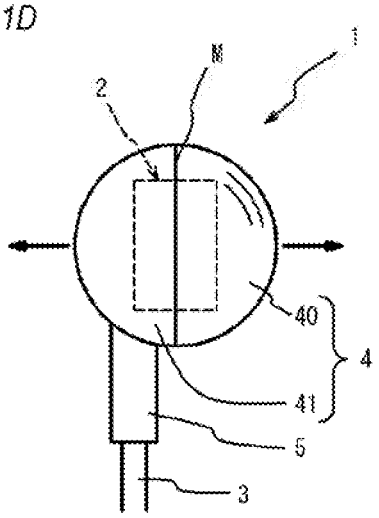

The inner housing portion 40 is shaped to have an ellipsoidal shape or an oval shape. Here, the ellipsoidal shape in the description of the present invention or the like means at least a portion of a curved surface that satisfies the following expression (Equation 1) when the center is placed at the origin of xyz Cartesian coordinates, as shown in FIG. 1B. Here, a, b, and c in the following expression (Equation 1) are lengths of three semiaxes orthogonal to one another. That is, a is the length of the semiaxis in the x direction, b is the length of the semiaxis in the y direction, and c is the length of the semiaxis in the z direction. A spheroidal shape having lengths of two semiaxes equal to each other or a spherical shape having lengths of three semiaxes equal to one another are also included in the ellipsoidal shape. In addition, the oval shape means at least a portion of a curved surface formed when, for example, a curved line such as a parabola or a catenary (catenary curve) in a two-dimensional plane is rotated about an axis of symmetry. The inner housing portion 40 in the present embodiment is formed into a shape (semi-spheroidal shape) obtained by cutting a spheroid with equal semi-axial lengths b and c in half along an xz plane. The outer housing portion 41 is also formed into the same semi-spheroidal shape as the inner housing portion 40. That is, the housing 4 in the present embodiment is formed as a single spheroid except for the cord leading-out portion 5. In the present embodiment, the lengths of the semiaxes of the inner housing portion 40 and the outer housing portion 41 coincide with each other, and a merging position M between the inner housing portion 40 and the outer housing portion 41 is the center of the housing 4, as shown in FIG. 1D. However, the merging position M is not limited thereto.

$$\frac{x^2}{a^2} + \frac{y^2}{b^2} + \frac{z^2}{c^2} = 1 \qquad \text{[Equation 1]}$$

In such a housing 4 constituted by the inner housing portion 40 and the outer housing portion 41, the aforementioned electromechanical transducer 2 is disposed at such a position that the center of the electromechanical transducer 2 coincides with the center of the housing 4, as shown in FIG. 1D. In addition, the direction in which the electromechanical transducer 2 mechanically vibrates is a direction perpendicular to a line of the merging position M between the inner housing portion 40 and the outer housing portion 41, and the inner housing portion 40 and the outer housing portion 41 vibrate in a direction designated by an arrow in FIG. 1D (a direction toward the external auditory canal when being attached to the cavum conchae).

Values of the three semi-axial lengths a, b, and c in the ellipsoidal shape or values defining the curved line of the oval shape can be selected desirably. However, as will be described later, the earphone 1 in the present embodiment is formed to have a size in which the housing 4 does not block the external auditory canal when being attached to the cavum conchae (the housing 4 may reach a part of an inlet of the external auditory canal, but does not completely cover the inlet of the external auditory canal). These values are selected in the range. Further, if the housing 4 is too large, the housing 4 is strongly pressed against the wall portion of the cavum conchae when being attached to the cavum conchae. This brings discomfort. If the housing 4 is too small, the electromechanical transducer 2 is also small to be incapable of obtaining sufficient output. Moreover, stability of the housing 4 is deteriorated when the housing 4 is attached to the cavum conchae. As a result of repeated studies on such a problem, it has been found that the width of the ellipsoidal shape or the oval shape is preferably set in a range of not smaller than 10 mm and not larger than 14 mm. This numerical range means that all diameters 2*a*, 2*b* and 2*c* of the ellipsoidal shape shown in FIG. 1C are not smaller than 10 mm and not larger than 14 mm. A more preferable range of the width is not smaller than 12 mm and not larger than 14 mm. Further, the shape is preferably formed as an approximately spherical shape.

The cord leading-out portion 5 in the present embodiment is shaped like a cylinder whose diameter is set at about 3 to 4 mm.

Figure 4:
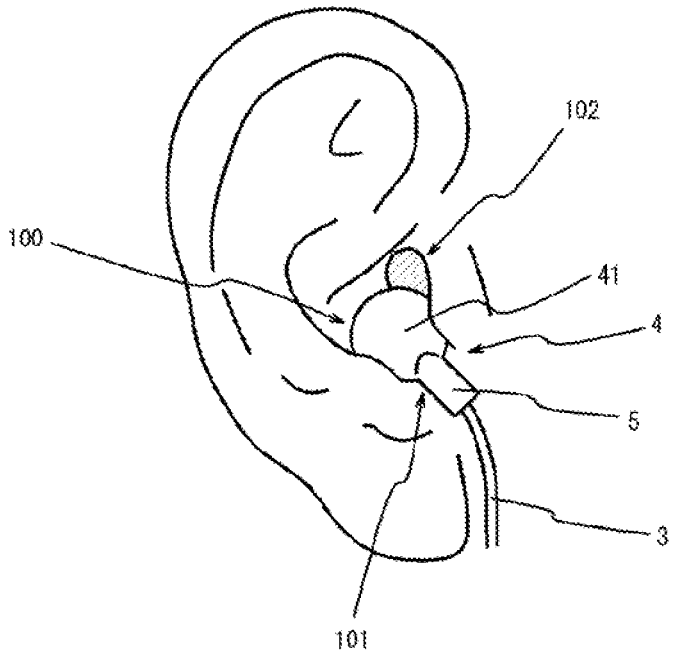
FIG. 4 illustrates a state in which the earphone shown in FIG. 1A has been worn in a cavum conchae.

The earphone 1 having such a form is used as shown in FIG. 4. Specifically, while the housing 4 is hooked on a lower part of a cavum conchae 100 shown in FIG. 4, the cord leading-out portion 5 is put into an intertragic notch 101 to be attached to the cavum conchae 100. In this state, the housing 4 does not block an inlet 102 (hatched portion in FIG. 4) of an external auditory canal. Therefore, the external auditory canal is in an open state to an external environment. In addition, on this occasion, the inner housing portion 40 shown in FIG. 1A abuts against a wall portion of the cavum conchae 100. Further, opposite sides of the outer housing portion 41 abut against inner wall portions of a tragus and an antitragus.

When an electric signal is applied to the electromechanical transducer 2 through the cord 3, the housing 4 vibrates correspondingly to mechanical vibration generated between the structure portion and the armature 17, and the inner housing portion 40 in itself serves as a vibrating plate to generate sound due to the vibration. That is, by the earphone 1, sound can be generated due to the vibration of the housing 4, so that the sound corresponding to the applied electric signal can be transmitted to an inner ear. Further, since the external auditory canal is not blocked by the housing 4, it is also possible to hear ambient sound in addition to the sound transmitted from the earphone 1. The housing 4 has an ellipsoidal shape or an oval shape and is small-sized. Therefore, when the housing 4 vibrates at a position where its distance to a person in the surroundings is sufficiently far in comparison with the size of the housing 4, sound generated due to vibration of the inner housing portion 40 and sound generated due to vibration of the outer housing portion 41 are cancelled with each other. Accordingly, an effect of suppressing sound leakage to the surroundings can be also obtained. On the other hand, as to a distance to the external auditory canal is short in comparison with the size of the housing 4, a difference between a distance from the external auditory canal to the inner housing portion 40 and a distance from the external auditory canal to the outer housing portion 41 affects. Accordingly, the sound to be transmitted to the eternal auditory canal can be hardly cancelled with each other.

Further, in the present embodiment, the cord leading-out portion 5 through which the cord 3 has been inserted can be attached in the cavum conchae 100 in accordance with a cavity of the intertragic notch 101. Therefore, the cord 3 can be naturally led out of the cavum conchae 100. In addition, the cord leading-out portion 5 is received in the intertragic notch 101. Therefore, the housing 4 can be retained stably when being attached to the cavum conchae 100. In addition, the balanced armature type electromechanical transducer 2 which uses the restoring forces of the springs and which belongs to the earphone 1 in the present embodiment can vibrate the housing 4 at high output. Accordingly, sound can be sufficiently transmitted by the vibration of the housing 4 even if the inner housing portion 40 is not so strongly pressed against the wall portion of the cavum conchae 1X). That is, since vibration outputted by an existing electromechanical transducer is so small that the housing has to be strongly pressed against the wall portion or the like of the cavum conchae in order to transmit sound to the inner ear, long-term use thereof may cause discomfort. In contrast, by using of the aforementioned electromechanical transducer 2 according to the present embodiment, the discomfort can be also suppressed.

Figure 5A:
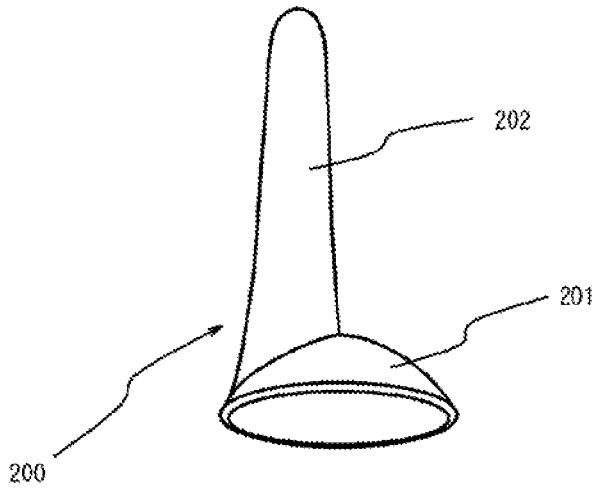
Figure 5B:
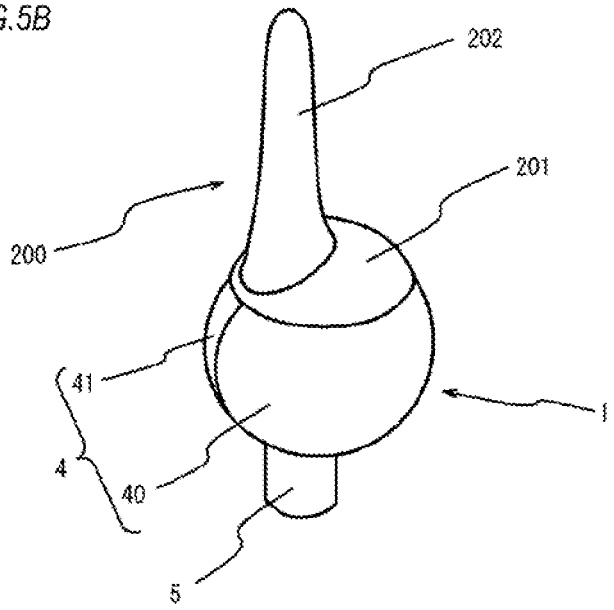
Figure 6:
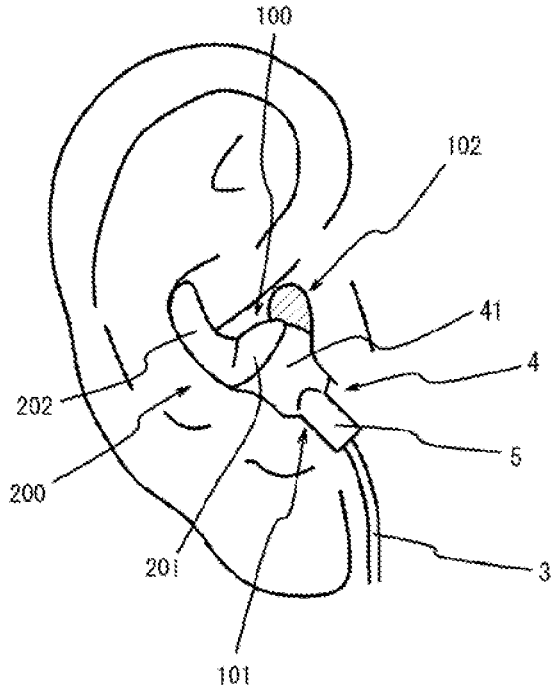
FIG. 6 illustrates a state in which the earphone to which the adapter has been attached is worn in the cavum conchae.

The aforementioned earphone 1 is worn so that the housing 4 is hung on the lower part of the cavum conchae 100. Accordingly, the earphone 1 may be unstable when being used outdoors or during exercise. In this case, for example, an adhesive tape or the like may be used on the lower part of the housing 4 to prevent the earphone 1 from moving in the cavum conchae 100. Further, an adapter 200 shown in FIG. 5A may be attached in use. The adapter 200 in the present embodiment is, for example, formed out of a polymeric elastomer such as silicone. The adapter 200 is constituted by abase portion 201 and an approximately columnar stem portion 202. The base portion 201 is shaped like a spherical crown to function as a suction cup. The stem portion 202 rises up eccentrically from the base portion 201. As shown in FIG. 5B, the base portion 201 is attached to an upper part of the housing 4, so that the base portion 201 can be arranged in the cavum conchae 100, as shown in FIG. 6. In this state, a distal end of the stem portion 202 abuts against an upper-side wall portion (wall portion near an antihelix) of the cavum conchae 100. Accordingly, the housing 4 is pressed toward the antitragus and the tragus on the lower side by the base portion 201. That is, the housing 4 is retained so as to be held vertically in the cavum conchae 100. Accordingly, the housing 4 can be used stably even during exercise.

Although the earphone which is an embodiment of the electroacoustic transducer according to the present invention has been described above, the present invention is not limited to the aforementioned embodiment but may also include various modifications made within a category complying with the scope of Claims. For example, the aforementioned outer housing portion 41 has the same semi-spheroidal shape as the inner housing portion 40. However, the outer housing portion 41 may be set to have an ellipsoidal shape whose semiaxes are different from those of the inner housing portion 40. Further, a shape obtained by combining a plurality of basic shapes with one another (e.g. a shape which is mostly formed as an ellipsoid but partially provided with a flat surface, or the like) may be used.

Figure 7A:
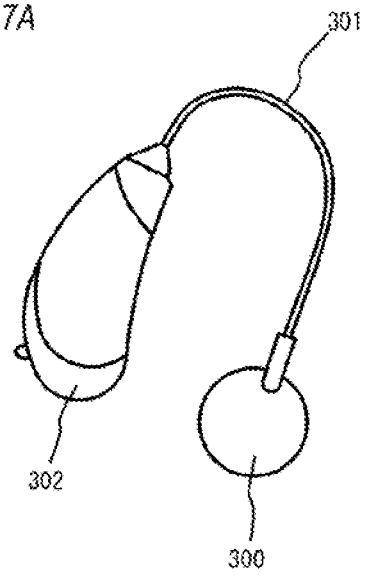
FIGS. 7A to 7C illustrate embodiments of a hearing aid (acoustic device) provided with the earphone according to the present invention.
Figure 7B:
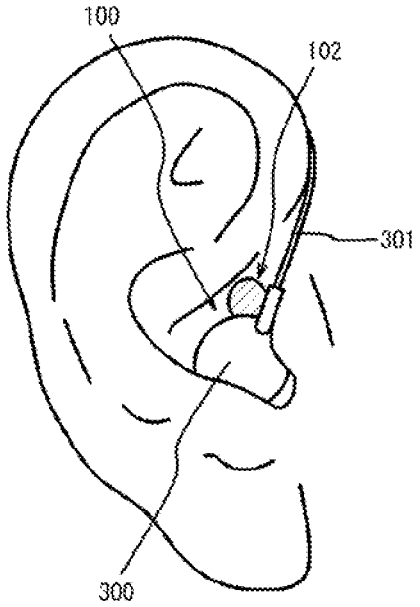
Figure 7C:
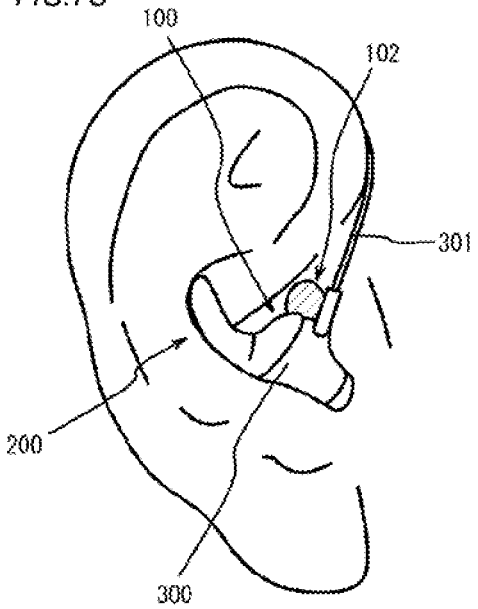

Further, the acoustic device using the electroacoustic transducer according to the present invention is not limited to an audio device but may be a hearing aid. An example of such a hearing aid is a behind-the-ear type hearing aid which is provided with a housing 300 the same as the aforementioned one, and a body portion 302 connected to the housing 300 through a thin electric wire cord 301, for example, as shown in FIG. 7A. As shown in FIG. 7B, the thin electric wire cord 301 of such a behind-the-ear type hearing aid is hung on an auricle of an ear in a state in which the body portion 302 is located behind the auricle, and the housing 300 can be inserted into the cavum conchae 100 to be thereby attached thereto. Further, the aforementioned adapter 200 may be attached in use, as shown in FIG. 7C. In addition, when used as an earphone, such a behind-the-ear type configuration may be employed. In this case, a cordless earphone that does not use the aforementioned cord 3 can be realized, for example, by designing the body portion to have a wireless communication function such as Bluetooth (registered trademark). Further, since the housing 4 does not have any sound outlet for air conduction sound, an electroacoustic transducer and an audio device both of which have a waterproof function can be also easily realized.

REFERENCE SIGNS LIST

1: earphone (electroacoustic transducer)
2: electromechanical transducer
3: cord
4: housing
40: inner housing portion
41: outer housing portion
5: cord leading-out portion

The invention claimed is:

1. An electroacoustic transducer comprising:

an electromechanical transducer configured to transduce an electric signal into mechanical vibration; and a housing including an inner housing portion and an outer housing portion forming an ellipsoidal shape or an oval shape, the electromechanical transducer is disposed between the inner housing portion and the outer housing portion, wherein the inner housing portion and the outer housing portion are capable of being attached to a cavum conchae without blocking an external auditory canal, in which the electromechanical transducer is housed, wherein the housing is configured to vibrate due to the mechanical vibration caused by the electromechanical transducer to generate sound, and wherein the inner housing portion is located on the external auditory canal side and the outer housing portion is located on an external environment side when the housing is attached to the cavum conchae.

2. The electroacoustic transducer according to claim 1, wherein a width of the ellipsoidal shape or the oval shape of the housing is not smaller than 10 mm and not larger than 14 mm.

3. The electroacoustic transducer according to claim 1, wherein the electromechanical transducer configured to vibrate the housing in a direction toward the external auditory canal.

4. The electroacoustic transducer according to claim 3, wherein the electromechanical transducer is disposed in between the inner housing portion and the outer housing portion at a position that a center of the electromechanical transducer is positioned along the direction of vibration toward the external auditory canal.

5. The electroacoustic transducer according to claim 1, wherein the electromechanical transducer is disposed in the housing at a position that a center of the electromechanical transducer coincides with a center of the housing.

6. The electroacoustic transducer according to claim 1, wherein the outer housing portion includes a cord leading-out portion through which a cord connected to the electromechanical transducer is inserted.

7. An acoustic device comprising the electroacoustic transducer according to claim 1.

* * * * *